US005891326A

United States Patent [19]

Shi et al.

[11] Patent Number: 5,891,326

[45] Date of Patent: Apr. 6, 1999

[54] PROCESS FOR REMOVING IMPURITIES FROM KAOLIN CLAYS

[75] Inventors: Joseph C. S. Shi, Bartow; Jorge L. Yordan, Sandersville, both of Ga.

[73] Assignee: Thiele Kaolin Company, Sandersville, Ga.

[21] Appl. No.: 986,593

[22] Filed: Dec. 8, 1997

Related U.S. Application Data

[60] Continuation of Ser. No. 657,024, May 31, 1996, abandoned, which is a division of Ser. No. 398,375, Mar. 3, 1995, Pat. No. 5,522,986.

[51] Int. Cl.[6] ..... B03D 1/02

[52] U.S. Cl. ..... 209/166; 501/144; 501/145; 501/148; 106/486; 106/487; 423/328.1

[58] Field of Search ..... 209/166, 167; 106/486, 487; 501/149, 144, 145; 423/328.1

[56] References Cited

U.S. PATENT DOCUMENTS

| | | |
|---|---|---|
| 3,450,257 | 6/1969 | Cundy . |
| 4,518,491 | 5/1985 | Billimoria et al. . |
| 4,629,556 | 12/1986 | Yoon et al. . |
| 4,871,466 | 10/1989 | Wang et al. . |
| 4,929,343 | 5/1990 | Wang et al. . |
| 4,981,582 | 1/1991 | Yoon et al. . |
| 4,997,550 | 3/1991 | Cobb et al. . |
| 5,037,534 | 8/1991 | Harrison . |

FOREIGN PATENT DOCUMENTS 88112212.1 4/1989 European Pat. Off. .

OTHER PUBLICATIONS

*Hydroxamate Vs. Fatty Acid Flotation for the Benefication of Georgia Kaolin,* Chapter 22 from Reagents to Better Metallurgy—Society for Mining, Metallurgy, and Exploration, Inc.; Yordan et al., 1994.

*A Study of Carrier Flotation of Clay,* Chapter 57 from vol. 2—Proceedings of the International Symposium on Fine Particles Processing—American Institute of Mining, Metallurgical and Petroleum Engineers, Inc.; Wang et al., 1980.

*Westvaco L–5 tall oil fatty acid,* Product Information Sheet from Westvaco Co., 1992.

*Beneficiation of Kaolin Clay by Froth Flotation Using Hydroxamate Collectors,* Article from Minerals Engineering, vol. 5, Nos. 3–5, pp. 457–467; Yoon et al., 1992.

*S–6493 Mining Reagent,* p. 1 of Material Safety Data Sheet from Cytec Division of American Cyanamid Co., 1993.

*Primary Examiner*—Thomas M. Lithgow
*Attorney, Agent, or Firm*—Jones & Askew, LLP

[57] ABSTRACT

Colored impurities are removed from kaolin clay by an improved flotation process in which a blend of a fatty acid compound and a hydroxamate compound is used as a collector.

13 Claims, No Drawings

PROCESS FOR REMOVING IMPURITIES FROM KAOLIN CLAYS

This is a continuation application of application Ser. No. 08/657,024, filed May 31, 1996 (now abandoned) which in turn is a divisional application of application Ser. No. 08/398,375, filed Mar. 3, 1995, now U.S. Pat. No. 5,522,986.

TECHNICAL FIELD

This invention relates to a process for removing impurities from kaolin clays. In a more specific aspect, this invention relates to a process for removing colored impurities from kaolin clays in which a blend of a fatty acid compound and a hydroxamate compound is used as a collector. This invention also relates to kaolin clays produced by the process of this invention.

BACKGROUND OF THE INVENTION

Kaolin is a naturally occurring, relatively fine, white clay which may be generally described as a hydrated aluminum silicate. Kaolin clay, after purification and beneficiation, is widely used as a filler and pigment in various materials, such as rubber and resins, and in various coatings, such as paints and coatings for paper.

Crude kaolin clay, as mined, contains various forms of discoloring impurities, two major impurities being anatase ($TiO_2$)and iron oxides. To make the clay more acceptable for use in the paper industry, these impurities must be substantially removed by appropriate techniques.

The production of high brightness clays usually includes at least two processing steps. In a first step, a significant portion of the impurities, mainly anatase, is removed by employing one or more physical separation techniques, such as high gradient magnetic separation, froth flotation and/or selective flocculation. In a subsequent step, the remaining impurities, mainly iron oxides, are removed by known techniques, such as chemical leaching.

Froth flotation is regarded as one of the most efficient methods for removing colored impurities from kaolin clay. Typically, clays to be beneficiated by froth flotation are first blunged in the presence of a dispersant and pH modifier and then conditioned with a collector. The job of the collector is to selectively adsorb to impurities and render them hydrophobic. This part of the process is referred to as conditioning. The conditioned impurities, mainly titanium dioxide in the form of iron-rich anatase, are then removed in a flotation machine via the attachment of the hydrophobic impurities to air bubbles which are injected into the feed slurry or into the flotation pulp.

Two general categories of compounds are reported in the literature as collectors for titaniferous impurities in kaolin clay. Cundy U.S. Pat. No. 3,450,257 discloses the use of fatty acid compounds as collectors, and Yoon & Hilderbrand U.S. Pat. No. 4,629,556 discloses the use of hydroxamate compounds as collectors. Each category of compounds has advantages and disadvantages.

One of the advantages of the fatty acids is that, in addition to collecting impurities, they can also act as frothers when the pulp pH is 8.5 or higher. This may obviate the need for an additional frother in the process. A major disadvantage of fatty acids is that, for them to act as collectors, they must first be activated by polyvalent cations such as $Ca^{+2}$ and/or $Pb^{+2}$. Unfortunately, this activation process is not a very selective one. The activated collector can adsorb not only to the impurities but also to some of the clay particles which are consequently rendered hydrobophic and, therefore, prone to float as if they were impurities. This leads to losses of clay and inefficiencies in the flotation process.

The very high selectivity towards the impurities without needing an activator has made the hydroxamates a feasible alternative as collectors for titaniferous impurities in kaolin clay. The main disadvantage of hydroxamates is their relatively poor frothability (compared to the fatty acids), which makes the hydroxamates difficult to use in a column cell where a deep froth must be sustained; see Yoon et al., *Minerals Engineering*, Vol. 5, Nos. 3–5, pp. 457–467 (1992). This may necessitate the use of a frother when the separation is conducted in a column cell. The use of a frother with a hydroxamate is a disadvantage for two reasons: a) the reagent addition system is more complicated and b) frothers can cause excessive foam in the flotation product, thereby making further processing difficult and potentially damaging the quality of the final product. The use of an activator and a frother tends to make the flotation process difficult and less adaptable to different types of kaolin day.

Therefore, a need exists in the kaolin clay industry for a collector system which will selectively adsorb to the titaniferous impurities in kaolin clay and avoid the necessity of additional chemicals (e.g., activators and frothers).

SUMMARY OF THE INVENTION

Briefly described, the present invention provides an improved process for the removal of impurities from kaolin clay. More specifically, this invention provides an improved process for the removal of colored impurities from kaolin clay by froth flotation by using a blend of a fatty acid compound and a hydroxamate compound as a collector during flotation.

The present invention provides a process that utilizes the advantages of the prior art collectors which are either fatty acid compounds or hydroxamate compounds, while at the same time avoiding the disadvantages of such prior art collectors.

The present invention also provides kaolin clay from which colored impurities have been substantially removed.

Accordingly, an object of this invention is to provide a process for removing impurities from kaolin day.

Another object of this invention is to provide an improved process for removing colored impurities from kaolin clay by froth flotation.

Another object of this invention is to provide a process for removing colored impurities from kaolin clay in which the collector is a blend of a fatty acid compound and a hydroxamate compound.

Another object of this invention is to provide kaolin clay from which colored impurities have been substantially removed.

Another object of this invention is to provide a process for removing impurities from kaolin clay in which an activator compound is not required.

Another object of this invention is to provide an improved process for removing impurities from kaolin clay wherein the process is effective (i.e., adaptable) in treating different types of clay, such as coarse-grained and fine-grained clays.

Still another object of this invention is to provide a process for removing impurities from kaolin clay in which an additional frother compound is not required.

Still another object of this invention is to provide a process for removing impurities from kaolin clay which will utilize the advantages, but avoid the disadvantages, of the prior art collectors.

Still another object of this invention is to provide an improved process for removing impurities from kaolin clay wherein such day is a high brightness day.

Still another object of this invention is to provide an improved process for removing colored impurities from kaolin clay in which the collector, a blend of a fatty acid compound and a hydroxamate compound, is used in lesser amounts than the prior art collectors.

These and other objects, features and advantages of this invention will become apparent from the following detailed description.

DETAILED DESCRIPTION OF THE INVENTION

In accordance with the present invention, kaolin clay is treated (i.e., conditioned) with a collector to enable impurities to be removed in a subsequent froth flotation process.

We have discovered that, by using a blend of a fatty acid compound and a hydroxamate compound as the collector, the flotation process is more effective in removing impurities from kaolin clay as compared to using either compound alone as the collector. In addition, lesser amounts of the blend are used to obtain improved or equivalent results than when either compound is used alone.

As a first step in carrying out the process of this invention, the clay to be purified is blunged in water at an appropriate solids concentration. A relatively high pulp density, in the range of 35–70% solids by weight, is preferred since the interparticle scrubbing action in such pulps helps liberate colored impurities from the surfaces of the clay particles. High speed, high energy blunging, which tends to increase the scouring action, is preferred, but low speed, low energy blunging can also be used.

Following conventional practice, a suitable dispersant, such as sodium silicate or a polyacrylate is added during blunging in an amount, e.g., 1–20 lb per ton of dry solids, sufficient to produce a well-dispersed clay slip. An alkali, such as soda ash, sodium hydroxide, ammonium hydroxide, potassium hydroxide or lithium hydroxide is also added as needed to produce a pH above 6.0 and preferably within the range of 7.0–10.5.

The collector blend in accordance with the invention is added to the dispersed day slip under conditions, i.e., proper agitation speed, optimum pulp density and adequate temperature, which permit reaction between the collector and the colored impurities of the clay in a relatively short time.

The amount of collector blend added to the clay slip depends on the amount of impurities present in the clay, the nature of the clay to be processed, the amounts of other reagents used in the process and the amount of dry clay within the feed material. The amount of collector added must be sufficient to promote flotation of the impurities. In general, collector additions in the range of 0.2–8 lb per ton of dry day, preferably 0.5–6 lb per ton, are effective.

After conditioning with the collector is completed, the clay slip is transferred to a flotation cell, and if necessary or desirable, is diluted to a pulp density preferably within the range of about 15–45% solids by weight. The operation of the froth flotation machine is conducted in conventional fashion. After an appropriate period of operation, during which the titaniferous impurities are removed with the foam, the clay suspension left in the flotation cell can be leached for the removal of residual iron oxides, filtered and dried in conventional fashion.

In this invention, the froth flotation process is conventional and can be conducted in either a column cell or mechanical cell. In a column cell, the recovery of equivalent grades of kaolin clay are generally improved when compared to a mechanical cell.

In this invention, the blend contains a fatty acid compound, or a mixture of such compounds, having the general formula:

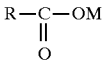

in which R is an alkyl, aryl or alkylaryl group having 1–26 carbon atoms, and M is hydrogen, an alkali metal or an alkaline earth metal.

Examples of suitable R groups include methyl, ethyl, butyl, octyl, lauryl, 2-ethylhexyl, oleyl, eicosyl, phenyl, naphthyl and hexylphenyl.

Examples of suitable alkali metals are lithium, sodium and potassium.

Examples of suitable alkaline earth metals are magnesium, calcium and barium.

These fatty acid compounds are commercially available, such as from Westvaco Corporation, Chemical Division, Charleston Heights, S.C.

An especially preferred fatty acid compound is commercially available from Westvaco Corporation under the trademark Westvaco L-5. This compound is a tall oil, which is a mixture of fatty acid compounds.

In this invention, the blend also contains a hydroxamate compound, or a mixture of such compounds, having the formula:

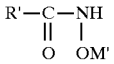

in which $R^1$ is an alkyl, aryl or alkylaryl group having 4–28 carbon atoms, and $M^1$ is hydrogen, an alkali metal or an alkaline earth metal.

Examples of suitable $R^1$ groups include butyl, hexyl, octyl, dodecyl, lauryl, 2-ethylhexyl, oleyl, eicosyl, phenyl, tolyl, naphthyl and hexylphenyl.

Examples of suitable alkali metals are lithium, sodium and potassium.

Examples of suitable alkaline earth metals are magnesium, calcium and barium.

These hydroxamate compounds are available commercially, such as from Cytec Industries, Inc., Patterson, N.J.

An especially preferred hydroxamate compound is commercially available from Cytec Industries, Inc. under the trademark S-6493 Mining Reagent. This compound is a mixture of alkyl hydroxamic acids.

The hydroxamate collectors used in the invention can be prepared by conventional methods, such as shown in Yoon & Hilderbrand U.S. Pat. No. 4,629,556; Wang & Nagaraj U.S. Pat. No. 4,871,466; and Wang & Nagaraj U.S. Pat. No. 4,929,343.

Examples of hydroxamates which are useful in the process of the invention include potassium butyl hydroxamate, potassium octyl hydroxamate, potassium lauryl hydroxamate, potassium 2-ethylhexyl hydroxamate, potassium oleyl hydroxamate, potassium eicosyl hydroxamate, potassium phenyl hydroxamate, potassium naphthyl hydroxamate, potassium hexylphenyl hydroxamate, and the corresponding salts of sodium and other alkali or alkaline earth metals. The salts can be converted to the corresponding acids by conventional methods known to those skilled in the art.

The process of this invention can be effectively practiced by first blunging kaolin clay in the presence of a dispersant, water, the collector blend of this invention to condition the impurities in the kaolin clay and a pH modifier to obtain a kaolin clay dispersion having a pH above 6.0. The kaolin clay dispersion is then subjected to froth flotation to substantially remove the impurities.

In a preferred embodiment of this invention, the kaolin clay is first blunged with a dispersant, water and a pH modifier to form a kaolin clay dispersion having a pH above 6.0. In a second step, the impurities are then conditioned by adding the collector blend of this invention to the kaolin clay dispersion under continued agitation. Again, the amount of collector added must be sufficient to promote flotation of the impurities. In a third step, the kaolin day dispersion is then subjected to froth flotation to substantially remove the impurities.

The time required for conditioning the impurities prior to flotation will vary depending upon the kaolin clay being processed. In general, however, conditioning will require at least about 5 minutes.

The present invention is further illustrated by the following examples which are illustrative of certain embodiments designed to teach those of ordinary skill in the art how to practice this invention and to represent the best mode contemplated for practicing this invention.

In the following examples, the efficiency of the various collectors in removing titaniferous impurities from kaolin clays by froth flotation will be compared using an index known as the "coefficient of separation"(C.S.), which was first used as a measure of process performance in kaolin flotation by Wang and Somasundaran; see *Fine Particles Processing*, Vol. 2, Chapter 57, pages 1112–1128 (1980). The C.S. index takes into account not only the amount of impurities removed by the process (grade) but also the amount of clay product lost (yield) as a result of the process. The mathematical expression used to compute the Coefficient of Separation is the following:

% Yield of Clay+% of $TiO_2$ removed by flotation −100

$$C.S. = \frac{\%\ \text{Yield of Clay} + \%\ \text{of } TiO_2 \text{ removed by flotation} - 100}{100}$$

in which the % yield of clay represents the weight of kaolin clay recovered in the clay product expressed in terms of percentage of the calculated total weight of kaolinite in the feed and the % of $TiO_2$ removed by flotation represents the weight of total $TiO_2$ rejected into the floated tailing expressed in terms of the percentages of the total weight of $TiO_2$ in the feed.

The value of the C.S. index varies theoretically from zero for no separation to 1 for a perfect separation as in the unrealistic case in which all (100%) of the impurities are removed from the kaolin with absolutely no loss (100% yield) of clay. In the case of kaolin beneficiation by froth flotation, the C.S. index typically ranges from 0.3 and 0.75.

In this patent application, the C.S. index is used to compare the efficiency of the blended system versus that of fatty acid or alkyl hydroxamates as collectors for kaolin flotation. For the purpose of comparison, the performance of any collector is considered different from that of another collector only when the C.S. indices differ by more than 0.1 units.

An ultimate object of removing titaniferous impurities from kaolin clays by flotation is to improve the GE brightness and color of the processed days. Those skilled in the art of kaolin beneficiation by froth flotation know that, to achieve GE brightness levels of or in excess of 90.0, the content of titaniferous impurities (as % $TiO_2$) in the final product should not exceed 0.5% for coarse-grained clays or 1.0% for fine-grained clays. One skilled in the art also knows that any attempt to try to reduce the content of impurities in the clay much further may result in an unacceptably large loss in clay yield and only a very marginal gain in brightness.

EXAMPLE I

A run-of-mine coarse-grained clay sample from the Ennis/Avant area in Washington County, Georgia, containing 1.55% $TiO_2$, is dispersed in a high speed blunger at 6200 RPM and 60% solids using 3 lb/ton of sodium silicate (on an active basis). The pH is adjusted to 8.2 by adding 3 lb/ton of soda ash during blunging. After 6 minutes of blunging, the collector is added and agitation continues for another 6 minutes at the same speed as in blunging. This procedure is repeated three times, each time using a different type of collector as indicated in Table I.

The collectors used are an alkyl hydroxamate (S6493) Mining Reagent; a tall oil (Westvaco L-5); and a blend of the two collectors.

Flotation tests are carried out on the conditioned clay slip after diluting the clay slip to 20% solids using a Denver D-12 flotation machine operating at 1800 rpm. Demineralized water is used for both blunging and flotation to obviate the possible effect of contamination in tap water.

After the flotation is completed, a portion of the beneficiated clay suspension left in the flotation cell is removed for measurement of pulp density, from which the yield of treated clay is determined, and for X-ray fluorescence analysis to determine the residual $TiO_2$ content. This information (yield and residual $TiO_2$) is used to calculate the coefficient of separation.

The blend of collectors removes the same amount of impurities that the other two collectors do but with the same efficiency (measured by the coefficient of separation) of the hydroxamate chemistry while using only half of the dosage of alkyl hydroxamate and only one-third of the dosage of the tall oil.

TABLE I

| Collector | lb/ton | % TiO2 remaining in product | Yield of clay (%) (c) | Amount of TiO2 removed by flotation (d) | Coefficient of separation |
|---|---|---|---|---|---|
| Tail Oil Fatty Add (a) | 3.0 | 0.30 | 64.9 | 81.0 | 0.46 |
| Alkyl Hydroxamate | 2.0 | 0.28 | 86.0 | 81.9 | 0.68 |
| BLEND | | | | | |
| Tall Oil Fatty Acid (b) | 1.0 | | | | |
| | | 0.31 | 86.6 | 80.0 | 0.67 |
| Alkyl Hydroxamate | 1.0 | | | | |

where:
(a) 0.5 lb/ton of $CaCl_2.H_2O$ is added as an activator
(b) 0.17 lb/ton of $CaCl_2.H_2O$ is added as an activator
(c) Yield of clay: Weight of kaolin clay recovered in the clay product expressed in terms of percentage of the calculated total weight of kaolinite in the feed.
(d) Amount of $TiO_2$ removed by flotation (%): Weight of total $TiO_2$ rejected into the floated tailing expressed in terms of the percentage of the total weight of $TiO_2$ in the feed.

EXAMPLE II

In this example, a day similar to the one in Example I is floated in a column cell. The clay is dispersed in a high-speed mixer using dispersant (sodium silicate or sodium polyacrylate). The pH of the slurry is adjusted to the required levels with soda ash or ammonium hydroxide depending on the collector used.

The conditioning of the clay is done in a separate high-speed mixer. The collectors employed are an alkyl hydroxamate (S-6493 Mining Reagent); tall oil (Westvaco L5); and a blend of these two collectors. The separation is carried out in a Control International column cell retrofitted with Microcel spargers at a rate of 300 lbs/hr. When pure alkyl hydroxamate is the collector used, 0.4 lb/ton of frother (Aerofroth 65, Cytec) is added to the column by injection through the spargers. No frother is added when the blend of collectors is used.

The performance of the blended collector is better than the performance obtained with the tall oil fatty acid system, and is equivalent to that of the hydroxamate/frother combination with the added benefit that no frother is required. Also, only one-fourth of the dosage of alkyl hydroxamate and only one-third of the dosage of the tall oil are used in the blended collector system.

TABLE II

| Collector | lb/ton | % $TiO_2$ remaining in product | Yield of clay (%) | Amount of $TiO_2$ removed by flotation | Coefficient of separation |
|---|---|---|---|---|---|
| Tall Oil Fatty Acid (a) | 3.0 | 0.40 | 81.6 | 74.2 | 0.56 |
| Alkyl Hydroxamate (b) | 2.0 | 0.41 | 96.4 | 73.5 | 0.70 |
| BLEND | | | | | |
| Tall Oil Fatty Add (c) | 1.0 | 0.27 | 84.8 | 82.6 | 0.67 |
| Alkyl Hydroxamate | 0.5 | | | | |
| BLEND | | | | | |
| Tall Oil Fatty Acid | 2.0 | 0.28 | 87.3 | 81.9 | 0.69 |
| Alkyl Hydroxamate | 1.0 | | | | |

where:
(a) 0.5 lb/ton of $CaCl_2.H_2O$ is added as an activator; 1.25 lb/ton sodium polyacrylate as the dispersant and 13.8 lb/ton of ammonium hydroxide (on as-received basis) to adjust pH to 9.8.
(b) 0.4 lb/ton of Aerofroth 65 (Cytec) is added as a frother; 2.22 lb/ton of sodium silicate as dispersant and 4.5 lbs/ton of soda ash to adjust pH.
(c) 0.25 lb/ton of $CaCl_2.H_2O$ is added as an activator; 2.22 lb/ton of sodium silicate as dispersant and 4.5 lbs/ton of soda ash to adjust pH to 8.2.

EXAMPLE III

A run-of-mine coarse-grained clay sample from the Ennis/Avant area in Washington County, Georgia containing 1.49% $TiO_2$, is dispersed in a high speed blunger (Cowles Dissolver) at 5500 RPM and 60% solids using 3 lb/ton of sodium silicate (on an active basis). The pH is adjusted to 8.0–8.6 by adding soda ash during blunging. After 6 minutes of blunging, the collector is added and agitation continues for another 6 minutes at the same speed as in blunging. This procedure is repeated three times, each time using a different type of collector as indicated in Table III results.

The collectors used are a tall oil fatty acid (Westvaco L-5); and a blend of a tall oil fatty acid (Westvaco L-5) and alkyl hydroxamate (S-6493 Mining Reagent), with and without calcium chloride.

Flotation tests are carried out on the conditioned clay slip after diluting it to 20% solids using a Denver D-12 flotation machine operating at 1800 rpm. After the flotation is completed, a portion of the beneficiated clay suspension left in the flotation cell is removed for measurement of pulp density, from which the yield of treated clay is determined, and for X-rays fluorescence analysis to determine the residual $TiO_2$ content.

Note that the blended collectors (Blend 1 and Blend 2) remove more impurities from the kaolin clays than the tall oil fatty acid as indicated by the lower amount of $TiO_2$ remaining in the clay products after flotation. As is the case in Examples I and II, note that lesser amounts of the blends are required. Table III shows that the performance of tall oil is better if calcium chloride is used. On the contrary, Table III shows that the performance of the blended collectors (i.e., the present invention) is not affected by the presence of calcium chloride. This is another advantage of using the blended collectors of this invention over the use of fatty acids.

TABLE III

| Collector | lb/ton | % $TiO_2$ remaining in product | Yield of clay (%) | Amount of $TiO_2$ removed by flotation | Coefficient of separation |
|---|---|---|---|---|---|
| Tail Oil Fatty Acid | 3.0 | 0.5 | 69 | 67.7 | 0.37 |
| Calcium Chloride | 0.5 | | | | |
| Tail Oil Fatty Acid | 3.0 | 0.6 | 74 | 61.3 | 0.35 |
| BLEND 1 | | | | | |
| Tall Oil Fatty Acid | 1.0 | 0.47 | 79.3 | 69.7 | 0.49 |
| Calcium Chloride | 0.17 | | | | |
| Alkyl Hydroxamate | 0.5 | | | | |
| BLEND 2 | | | | | |
| Tall Oil Fatty acid | 1.0 | 0.42 | 78.2 | 72.7 | 0.51 |
| Alkyl Hydroxamate | 0.5 | | | | |

EXAMPLE IV

In this example, a clay similar to the one in Example III is floated in a column cell. The clay is dispersed in a high-speed mixer at a rate of 600 lbs/hr using 6 lb/ton of sodium silicate at 60% solids. This dispersant is supplied as 50% sodium silicate and 50% water, and the reagent addition is calculated on an "as-received" basis. The pH of the slurry is adjusted to 8.2 with soda ash. The conditioning of the clay is done in a separate high-speed mixer in the presence of collector. The blend of tall oil fatty acid (Westvaco L-5 ) and alkyl hydroxamate (S-6493 Mining Reagent) is the collector used. Calcium chloride as the activator for tall oil is added in one of the tests and the results obtained are compared to those of another test done without calcium chloride. The separation is carried out in a Control International column cell retrofitted with Microcel spargers. No additional frother is added in either of the tests.

The blended collectors perform equally in the presence or absence of calcium chloride. This corroborates the findings in Example III indicating that an additional activator (calcium chloride in this case) is not required with the blended collectors.

TABLE IV

| Collector | lb/ton | % $TiO_2$ remaining in product | Yield of clay (%) | Amount of $TiO_2$ removed by flotation | Coefficient of separation |
|---|---|---|---|---|---|
| BLEND 1 | | | | | |
| Tall Oil Fatty Acid | 1.0 | | | | |
| Calcium Chloride | 0.17 | 0.22 | 75.2 | 85.8 | 0.61 |
| Alkyl Hydroxamate | 0.5 | | | | |
| BLEND 2 | | | | | |
| Tail Oil Fatty acid | 1.0 | | | | |
| | | 0.26 | 75.4 | 83.2 | 0.59 |
| Alkyl Hydroxamate | 0.5 | | | | |

EXAMPLE V

Coarse-grained clay from the Ennis Mine, Area-36 is floated twice in a column cell following the procedure detailed in Example IV to produce two separate products. In one case, the collector used is pure alkyl hydroxamate (S-6493 Mining Reagent) at a concentration of 2 lb/ton and, in the other case, the blend of tall oil fatty acid (Westvaco L-5) and alkyl hydroxamate (S-6493 Mining Reagent) is the collector used. The blend contains 1.0 lb/ton of Westvaco L-5 and 0.5 lb/ton of S-6493 Mining Reagent. No calcium chloride is used in those tests. The clay is dispersed with 2.2 lb/ton of sodium silicate (on an active basis), and the pH is adjusted to 8.2 with soda ash.

Upon completion of the flotation stage, the beneficiated clay suspension is classified by settling for a time period so that approximately 90% of the unsettled particles are finer than 2 microns equivalent spherical diameter. The fine fraction of the clay is coagulated by lowering the pH of the slurry to 3.5 with sulfuric acid and alum (2 lb/ton), leached with 9 lb/ton of sodium hydrosulfite ($Na_2S_2O_4$), filtered, dried and tested for brightness as described in TAPPI Standard T-646, OS-75. The viscosities of the slurries at 70% solids are measured using TAPPI method T-648 Om-88 as revised in 1988 which sets forth specific procedures for determination of both low and high shear viscosity.

Table V compares the results obtained with the Middle Georgia clay using hydroxamate and hydroxamate/tall oil blend collectors. After processing, the finished products are relatively similar in GE brightness and slurry viscosity, indicating that the clay product obtained with the blended collectors is as good as that obtained with the pure hydroxamate collector.

TABLE V

| Collector | lb/ton | % $TiO_2$ remaining in product | GE Brightness of Classified Products | Brookfield Viscosity (@ 70% solids and 20 rpm) cP | Hercules Viscosity (@ 1100 rpm) cP |
|---|---|---|---|---|---|
| Alkyl Hydroxamate (a) | 2.0 | 0.51 | 91.2 | 324 | 135 |

TABLE V-continued

| Collector | lb/ton | % $TiO_2$ remaining in product | GE Brightness of Classified Products | Brookfield Viscosity (@ 70% solids and 20 rpm) cP | Hercules Viscosity (@ 1100 rpm) cP |
|---|---|---|---|---|---|
| BLEND | | | | | |
| Alkyl Hydroxamate | 0.5 | 0.36 | 91.9 | 368 | 75 |
| Tail Oil Fatty Acid (b) | 1.5 | | | | |

(a) 2.22 lb/ton of sodium silicate as dispersant and 4.0 lb/ton of soda ash to adjust pH to 8.2.
(b) 2.22 lb/ton of sodium silicate as dispersant and 4.5 lb/ton of soda ash to adjust pH to 8.2.

This invention has been described in detail with particular reference to certain embodiments, but variations and modifications can be made without departing from the spirit and scope of the invention as defined in the following claims.

What is claimed is:

1. A kaolin clay dispersion from which titaniferous impurities have been substantially removed, wherein the kaolin clay dispersion is formed by a process which comprises the sequential steps of:

A. blunging kaolin clay in the presence of a dispersant, water, a collector to condition the impurities and a pH modifier to obtain a kaolin day dispersion having a pH above 6.0, wherein the amount of collector added is sufficient to promote flotation of the impurities; and B. subjecting the kaolin clay dispersion to froth flotation to substantially remove the impurities;

wherein the collector is a blend of (1) a fatty acid compound having the formula:

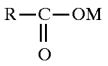

in which R is an alkyl, aryl or alkylaryl group having 1–26 carbon atoms, and M is hydrogen, an alkali metal or an alkaline earth metal and (2) a hydroxamate compound having the formula:

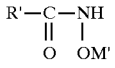

in which $R^1$ is an alkyl, aryl or alkylaryl group having 4–28 carbon atoms, and M is hydrogen, an alkali metal or an alkaline earth metal.

2. A kaolin clay dispersion as defined by claim 1 wherein the dispersant is sodium silicate or a polyacrylate.

3. A kaolin clay dispersion as defined by claim 1 wherein the pH modifier is soda ash, sodium hydroxide, ammonium hydroxide, potassium hydroxide or lithium hydroxide.

4. A kaolin clay dispersion as defined by claim 1 wherein the pH modifier is used to obtain a pH within the range of 7.0–10.5.

5. A kaolin clay dispersion as defined by claim 1 wherein the froth flotation is conducted in a column cell.

6. A kaolin clay dispersion as defined by claim 1 wherein the froth flotation is conducted in a mechanical cell.

7. A kaolin clay dispersion as defined by claim 1 wherein, in the general formula for the fatty acid compound, R is methyl, ethyl, butyl, octyl, lauryl, 2-ethylhexyl, oleyl, eicosyl, phenyl, naphthyl or hexylphenyl.

8. A kaolin clay dispersion as defined by claim 1 wherein, in the general formula for the fatty acid compound, M is hydrogen, lithium, sodium, potassium, magnesium, calcium or barium.

9. A kaolin clay dispersion as defined by claim 1 wherein the fatty acid compound is a tall oil.

10. A kaolin clay dispersion as defined by claim 1 wherein, in the general formula for the hydroxamate compound, $R^1$ is butyl, hexyl, octyl, dodecyl, lauryl, 2-ethylhexyl, oleyl, eicosyl, phenyl, tolyl, naphthyl or hexylphenyl.

11. A kaolin clay dispersion as defined by claim 1 wherein, in the general formula for the hydroxamate compound, $M^1$ is hydrogen, lithium, sodium, potassium, magnesium, calcium or barium.

12. A kaolin clay dispersion as defined by claim 1 wherein the hydroxamate compound is an alkyl hydroxamate.

13. A kaolin clay dispersion from which titaniferous impurities have been substantially removed, wherein the kaolin clay dispersion is formed by a process which comprises the sequential steps of:

A. blunging kaolin clay in the presence of a dispersant, water and a pH modifier to form a kaolin clay dispersion having a pH above 6.0;

B. conditioning the impurities by adding a collector to the kaolin clay dispersion under continued agitation, wherein the amount of collector added is sufficient to promote flotation of the impurities; and C. subjecting the kaolin clay dispersion to froth flotation to substantially remove the impurities;

wherein the collector is a blend of (1) a fatty acid compound having the formula:

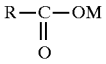

in which R is an alkyl, aryl or alkylaryl group having 1–26 carbon atoms, and M is hydrogen, an alkali metal or an alkaline earth metal and (2) a hydroxamate compound having the formula:

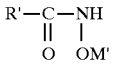

in which $R^1$ is an alkyl, aryl or alkylaryl group having 4–28 carbon atoms, and $M^1$ is hydrogen, an alkali metal or an alkaline earth metal.

* * * * *